US010337476B2

(12) United States Patent
Niwa et al.

(10) Patent No.: US 10,337,476 B2
(45) Date of Patent: Jul. 2, 2019

(54) FUEL SUPPLY DEVICES

(71) Applicant: AISAN KOGYO KABUSHIKI KAISHA, Obu-shi, Aichi-ken (JP)

(72) Inventors: Kensuke Niwa, Nagoya (JP); Koji Yoshida, Kasugai (JP); Tatsuki Fukui, Novi, MI (US); Hiroyasu Kariya, Kariya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 154 days.

(21) Appl. No.: 15/521,754

(22) PCT Filed: Oct. 21, 2015

(86) PCT No.: PCT/JP2015/079659
§ 371 (c)(1),
(2) Date: Apr. 25, 2017

(87) PCT Pub. No.: WO2016/072260
PCT Pub. Date: May 12, 2016

(65) Prior Publication Data

US 2017/0248106 A1 Aug. 31, 2017

(30) Foreign Application Priority Data

Nov. 6, 2014 (JP) ..... 2014-225907

(51) Int. Cl.
*F02M 37/10* (2006.01)

(52) U.S. Cl.
CPC ..... *F02M 37/10* (2013.01); *F02M 37/103* (2013.01)

(58) Field of Classification Search
CPC ..... F02M 37/10; F02M 37/103
See application file for complete search history.

(56) References Cited

U.S. PATENT DOCUMENTS 6,716,000 B2 4/2004 Appleton et al.

FOREIGN PATENT DOCUMENTS

JP S63-106517 U 7/1988
JP 9-257013 A 9/1997
(Continued)

OTHER PUBLICATIONS

Japanese Office Action dated Nov. 7, 2017, for Japanese Application No. 2014-225907 (3 p.).
(Continued)

*Primary Examiner* — Jacob M Amick
*Assistant Examiner* — Charles Brauch
(74) *Attorney, Agent, or Firm* — Conley Rose, P.C.

(57) ABSTRACT

A fuel supply device includes a cover, a base including a base main body, and a connecting portion configured to connect the cover and the base. The base main body and the connecting portion are connected by a connecting shaft comprising a shaft portion and a bulge portion, a connecting hole formed so as to continuously extend an engagement region and an insertion region, and a stopper piece capable of limiting a movable range of the shaft portion located within the engagement region towards the insertion region. A guide mechanism is provided for guiding the connecting shaft to move so that at least one part of the stopper piece is positioned between the bulge portion and the base portion when a predetermined amount of force is applied to the connecting shaft.

9 Claims, 7 Drawing Sheets

(56) References Cited

FOREIGN PATENT DOCUMENTS

| | | | | |
|---|---|---|---|---|
| JP | 2003-97373 | A | | 4/2003 |
| JP | 2003-521631 | A | | 7/2003 |
| JP | 2004-217039 | A | | 8/2004 |
| JP | 2012-184760 | A | | 9/2012 |
| JP | 2012184760 | A | * | 9/2012 |

OTHER PUBLICATIONS

English Translation of Japanese Office Action dated Nov. 7, 2017, for Japanese Application No. 2014-225907 (3 p.).
International Patent Application No. PCT/JP2015/079659 International Search Report dated Jan. 19, 2016 (5 pages).

* cited by examiner

FUEL SUPPLY DEVICES

CROSS-REFERENCE TO RELATED APPLICATIONS

The present application is a National Phase entry of, and claims priority to, PCT Application No. PCT/JP2015/079659, filed Oct. 21, 2015, which claims priority to Japanese Patent Application No. 2014-225907, filed Nov. 6, 2014, both of which are incorporated by reference herein in their entireties for all purposes.

STATEMENT REGARDING FEDERALLY SPONSORED RESEARCH OR DEVELOPMENT

Not applicable.

BACKGROUND

The present disclosure relates to a fuel supply device. More particularly, it relates to a fuel supply device for supplying fuel from within a fuel tank to an internal combustion engine wherein the fuel tank is mounted to a vehicle, e.g. an automobile.

A fuel supply device used for supplying fuel from within a fuel tank to an internal combustion engine is widely known in the art. Japanese Laid-Open Patent Publication No. 2012-184760 discloses a technique in that a base main body is pivotably mounted to a connecting portion provided at the fuel supply device. More particularly, a connecting shaft provided at the base is hooked to a connecting hole formed in the connecting portion through pushing an elastically deformable stopper piece away. In this way the base is pivotably mounted to the connecting portion. However, this configuration can still be further improved.

BRIEF SUMMARY

According to the above prior art fuel supply device, the connecting shaft could possibly be disconnected from the connecting hole when the connecting shaft moves to deform the stopper piece, such that the stopper piece is pushed out during assembly work. Therefore, there is a need for a structure that prevents the disconnection of the connecting shaft from the connecting hole to maintain a connection between the base and the connecting portion.

BRIEF DESCRIPTION OF THE DRAWINGS

According to one aspect of the present disclosure, a fuel supply device includes a cover configured to cover an opening of a fuel tank, a base including a base main body configured to abut a bottom surface of the fuel tank, and a connecting portion configured to connect the cover and the base. The base main body and the connecting portion are connected by a connecting shaft, a connecting hole and a stopper piece. The connecting shaft includes a shaft portion extending from a base portion and a bulge portion arranged at an end of the shaft portion. The connecting hole includes an engagement region where the shaft portion is allowed to pass through while the bulge portion is not, and an insertion region where the bulge portion is allowed to pass through wherein the insertion region is contiguous with the engagement region. The stopper piece is configured to limit a movable range of the shaft portion towards the insertion region when the shaft portion is located within the engagement region. A guide mechanism is provided for guiding at least one part of the connecting shaft or the stopper piece to move so that at least one part of the stopper piece is positioned between the bulge portion and the base portion when a predetermined amount of force is applied to the connecting shaft. Therefore, the connecting shaft may be prevented from disengaging from the connecting hole.

According to another aspect, the guide mechanism may be configured to guide at least one part of the stopper piece to move towards the base portion. In this way, the connecting shaft is not necessarily configured in a deformable manner, and therefore the connection between the base and the connecting portion may be maintained well.

According to another aspect, the stopper piece may be formed with an inclined surface in a position opposed to the bulge portion. At least one part of the stopper piece may be positioned between the bulge portion and the base portion when the bulge portion moves along the inclined surface. In this manner, the connecting shaft may be prevented from disengaging from the connecting hole with thee structure of the formed inclined surface.

BRIEF DESCRIPTION OF THE DRAWINGS

Figure 1:
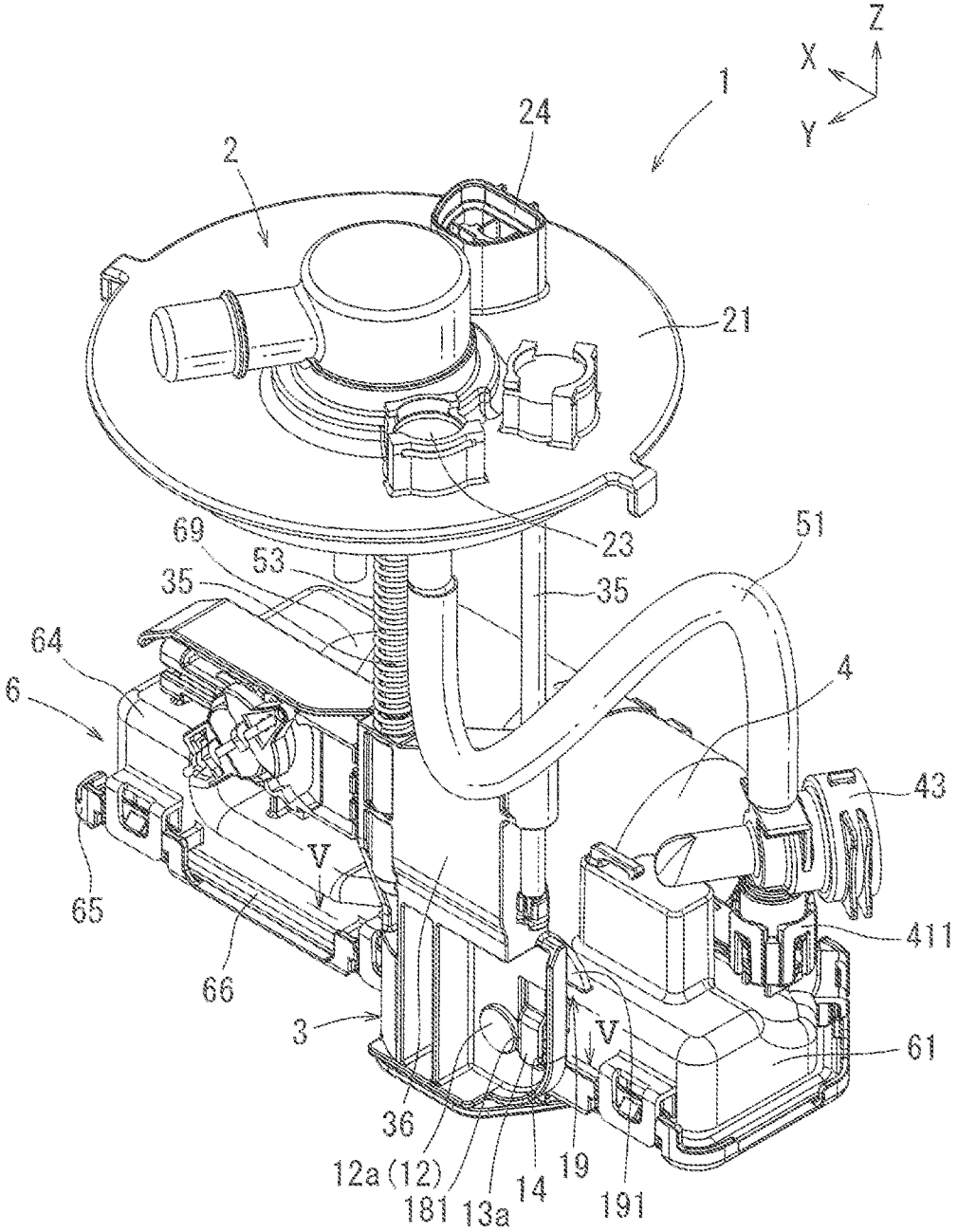

FIG. 1 is a perspective view of a fuel supply device.

Figure 2:
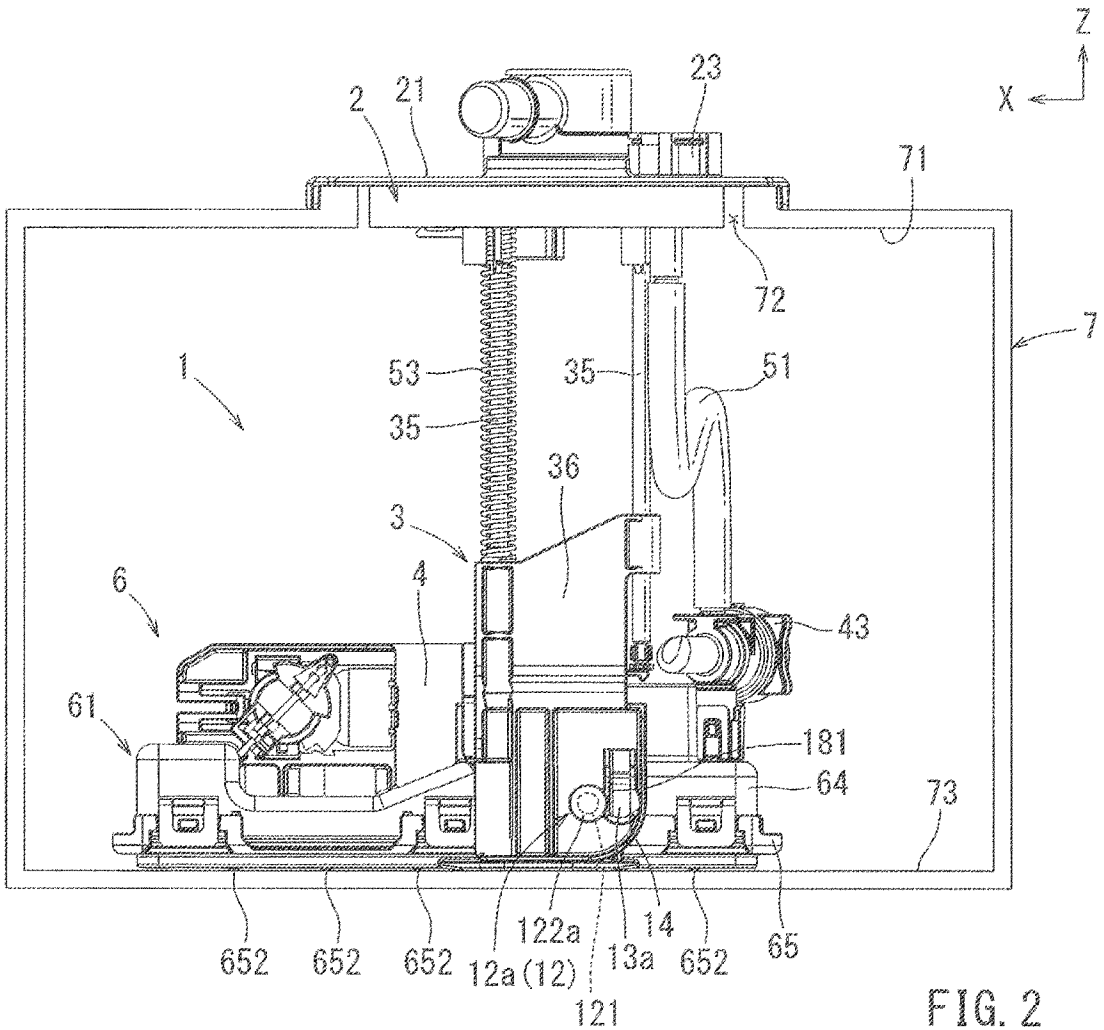

FIG. 2 is a left side view of the fuel supply device attached to a fuel tank.

Figure 3:
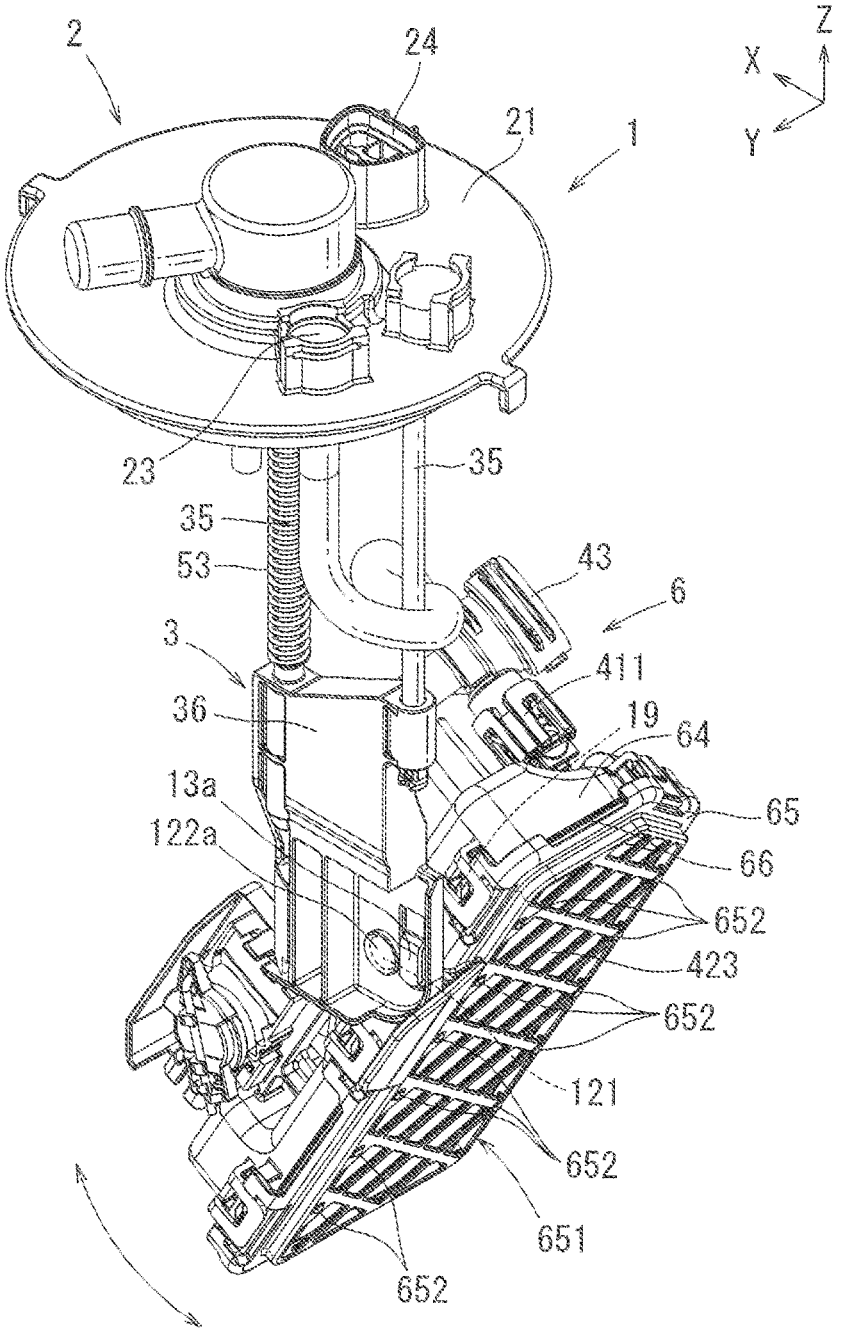

FIG. 3 is a perspective view illustrating the fuel supply device wherein a base main body is inclined.

Figure 4:
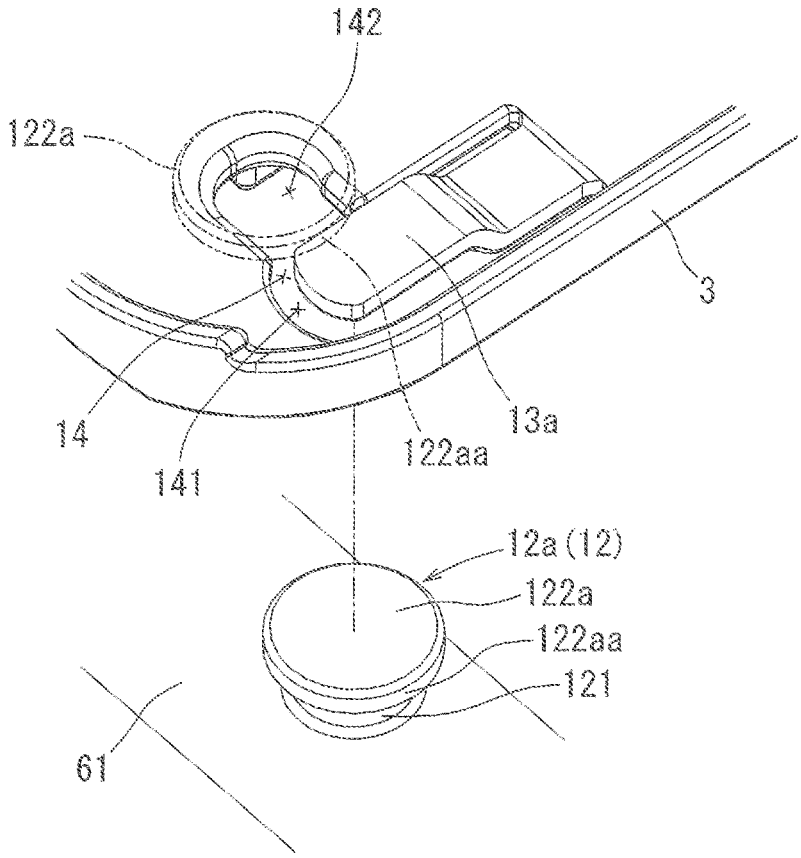

FIG. 4 is a view illustrating a connecting shaft to be attached to a connecting hole.

Figure 5:
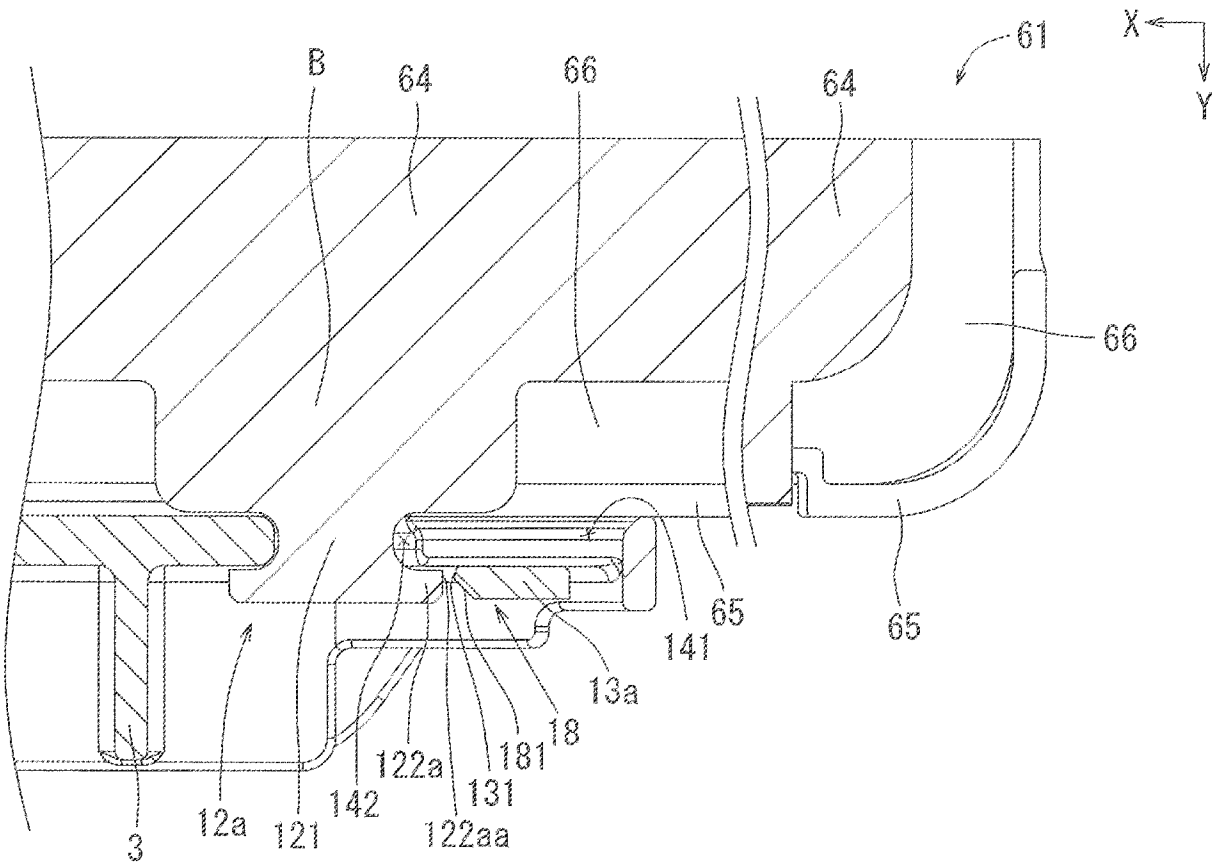

FIG. 5 is a partially enlarged cross sectional view around a guide mechanism.

Figure 6:
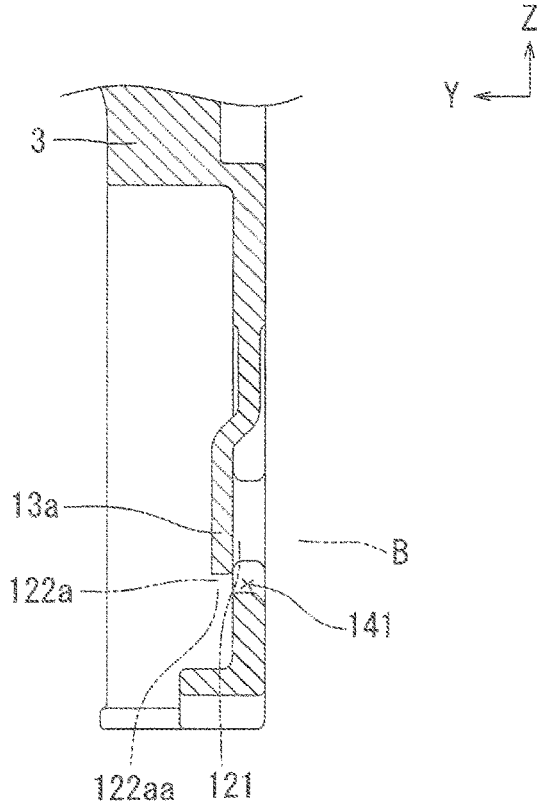

FIG. 6 is a view illustrating the relationship between the connecting shaft and the stopper piece.

Figure 7:
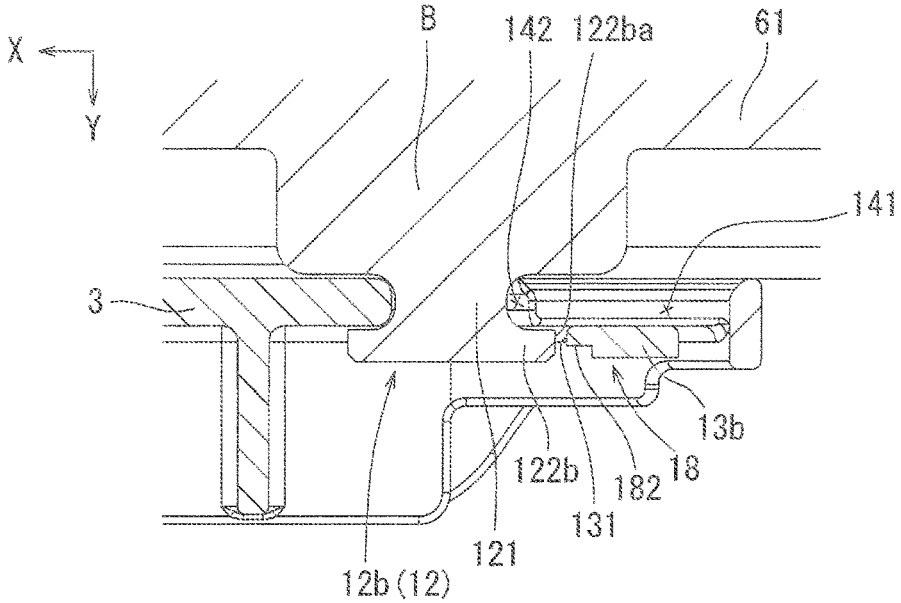

FIG. 7 is a partially enlarged cross sectional view around a guide mechanism according to another embodiment.

Figure 8:
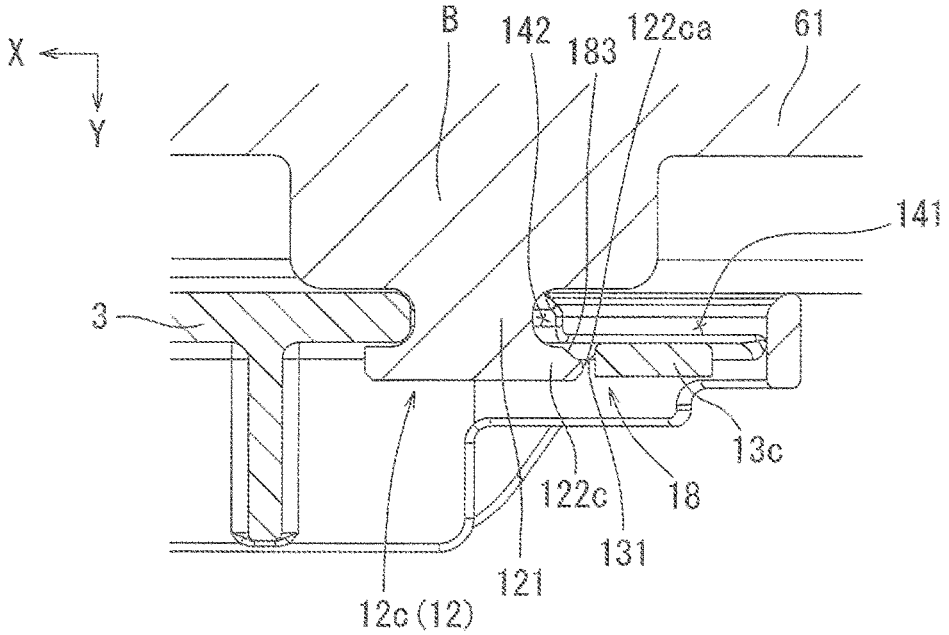

FIG. 8 is a partially enlarged cross sectional view around a guide mechanism according to another embodiment.

Figure 9:
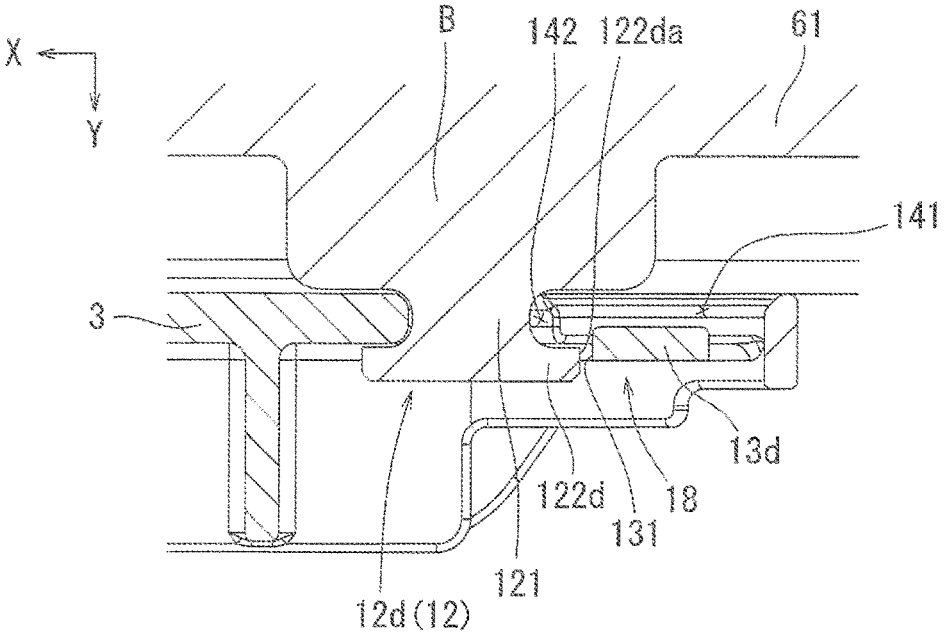

FIG. 9 is a partially enlarged cross sectional view around a guide mechanism according to another embodiment.

DETAILED DESCRIPTION

One embodiment of the present disclosure will now be described with reference to the drawings. The forward and backward directions, upward and downward directions as well as leftward and rightward directions in the present specification are determined such that X is a forward direction, Y is a leftward direction and Z is an upward direction as shown in FIG. 1, where the backwards, rightwards, and downwards directions extend in the negative opposing direction of X, Y, and Z, respectively. A cover 2 of a fuel supply device 1 is usually positioned at an upper direction relative to a base 6, which is positioned at a downward position relative to the cover 2. A connecting shaft 12 extends in the leftward and rightward directions with respect to a base main body 61. The forward and backward directions are perpendicular to and intersect the leftward and rightward directions as well as the upward and downward directions. In the description that follows, the directions are referred to with the assumption that the fuel supply device 1 is attached to the fuel tank 7, as shown in FIG. 2, unless otherwise specifically noted.

A fuel supply device 1 as shown in FIG. 1 may be mounted on a vehicle, and particularly, for example, on an automobile. The fuel supply device 1 is attached to a fuel tank 7 arranged below the floor of the vehicle. The fuel supply device 1 is used to feed liquid fuel stored within the fuel tank 7 into an internal combustion engine (not shown).

As shown in FIGS. 1 and 2, the fuel supply device 1 has the cover 2 attached to an opening 72 formed in an upper surface 71 of the fuel tank 7 and a pump unit 4 having a fuel pump (not shown) for delivering fuel within the fuel tank 7 to the outside. The fuel supply device 1 further includes a base 6 capable of abutting a bottom surface 73 of the fuel tank 7, and a connecting portion 3 for connecting the cover 2 and the base 6. The base 6 may be placed on the bottom surface 73 of the fuel tank 7. If the cover 2 is attached to the opening 72, the opening 72 of the fuel tank 7 can be closed while the base 6 may abut and lie flush against the bottom surface 73 of the fuel tank 7.

As show in FIGS. 1 and 2, the cover 2 includes a set plate 21 which covers the opening 72 of the fuel tank 7. The substantially disk-shaped set plate portion 21 includes an outlet port 23 for leading fuel delivered from the pump unit 4 to the outside of the fuel tank 7. Further, an electric connector 24 for connecting electric wiring is provided on the set plate 21. The opening 72 of the fuel tank 7 normally has a circular shape. As seen from a plan view the set plate 21 also has a substantially circular shape, which is concentric with and thus corresponds to the shape of the opening 72. A ring made of resin, for example an O-ring (not shown), may be attached to the opening 72 as a sealing member in order to prevent a gap from being formed between the fuel tank 7 and the cover 2.

As shown in FIGS. 2 and 3, the connecting portion 3 is telescopic and configured to be extendable and retractable. The connecting portion 3 includes a rod member 35 attached to the cover 2 and a joint portion 36 which is movable along the rod member 35. The rod member 35 extends in a direction perpendicular to the plane in which the set plate 21 extends radially. Further, a spring member 53 that can exert elastic force is arranged between the joint portion 36 and the cover 2. The spring member 53 biases the pump unit 4 to move away from the cover 2 whenever the cover 2 and the pump unit 4 mutually approach closer than a predetermined distance. In this manner, the spring member 53 is compressed while the cover 2 is moved towards the bottom surface 73 of the fuel tank 7 from the state in which the bottom surface of the pump unit 4 abuts and contacts the bottom surface 73 of the fuel tank 7. As long as this compressed state of spring member 53 is maintained, the pressed state of pump unit 4 against the bottom surface 73 of the fuel tank 7 will also be maintained.

As shown in FIGS. 1 and 2, the pump unit 4 is arranged below the cover 2. The pump unit 4 includes a fuel pump for delivering fuel and a pump casing for covering the fuel pump, and is supported at the base main body 61. The base main body 61 is formed as a substantially flat plate shape and is arranged such that one of its surfaces faces the bottom surface 73 of the fuel tank 7. The base main body 61 may also be referred to as a fuel reservoir or a sub-tank etc. The base main body 61 includes an upper base 64 to which the fuel pump is attached, a lower base 65 which contacts the bottom surface 73 of the fuel tank 7, and a filter member 66 interleaved between the upper base 64 and the lower base 65. A suction port 69 which is connected to the fuel pump is formed in an upper base 64 such that the fuel pump may suck the fuel passed through the filter member 66 through the suction port 69.

As shown in FIG. 3, a bottom surface of the lower base 65 is formed with a bottom surface opening 651 that is comprised of a lattice-covered opening. The lower base 65 comprises legs 652 which provide clearance between the lower base and the bottom surface of tank 7 thus forming an opening such that the fuel can be sucked from the bottom surface opening 651 even when the lower base 65 is arranged to contact with the bottom surface 73 of the fuel tank 7 (see FIG. 2). Further, the outer perimeter of the upper base 64 is configured to be slightly smaller than the outer perimeter of the lower base 65. Thus, a radial gap is formed between the upper base 64 and the lower base 65 along the length of their respective outside perimeters when the filter member 66 is not interleaved in between the upper base 64 and the lower base 65. The gap serves to introduce fuel into the base main body 61. The basal bottom surface of the upper base 64 is arranged so as to be covered by the filter member 66. Therefore, the fuel entering into the base main body 61 from the gap arrives at the fuel pump after passing through the filter member 66.

As shown in FIG. 1, a pressure adjusting valve 43 for adjusting feed pressure of the fuel is attached at the pump unit 4. The pressure adjusting valve 43 is attached to a valve supporting portion 411 extending from the fuel pump. The fuel with pressure adjusted by the pressure adjusting valve 43 is delivered to the internal combustion engine through a hose 51 and the discharge port 23 etc.

As shown in FIGS. 1 and 2, the connecting portion 3 and the base 6 may be connected in a relative movable manner via the insertion of the connecting shaft 12*a* into, and through its engagement with, the connecting hole 14. The connecting shaft 12*a* is formed to extend from the base main body 61 towards the connecting portion 3, wherein the connecting hole 14 is formed in the connecting portion 3. Therefore, through this engagement, the base 6 is able to rotate upwards or downwards about the connecting shaft 12*a* parallel to the y-axis, from the XY plane, relative to the connecting portion 3, when the cover 2 of the fuel supply device 1 is held and lifted (see FIG. 1 and FIG. 3 showing the held and lifted configurations, respectively). When rotated, one longitudinal end of the base main body 61 faces the bottom surface 73 of the fuel tank 7. A rotation regulation mechanism 19 is provided for regulating a rotation range of the base 6 with respect to the connecting portion 3. As shown in FIG. 1, the rotation regulation mechanism 19 includes a rotation regulation portion 191 provided, as a flange, for example, at the outer periphery of the top basal surface of base 6. The rotation regulation portion 191 contacts the connecting portion 3 when the base 6 rotates to a predetermined position, thereby ensuring that the rotation of the base 6 can be regulated.

As shown in FIG. 5, a base portion B is one part of the base main body 61, and a connecting shaft 12*a* extends from the base portion B. The connecting shaft 12*a* includes a shaft portion 121 and a bulge portion 122*a* provided at a tip end of the shaft portion 121. The bulge portion 122*a* is formed to have a substantially columnar shape in the Y direction of the XY plane and is configured such that a cross sectional area of the bulge portion 122*a* parallel to the XZ plane is larger than a cross sectional area of the shaft portion 121 parallel to the XZ plane, wherein said cross sectional plane is perpendicular to and intersects a central axis of the connecting shaft 12*a* parallel to the Y axis. Further, the shaft portion 121 extends from the base main body 61 towards an outer peripheral side and is configured to have a bi-tiered substantially columnar shape, with each tier having a different columnar thickness. A central axis of the bulge portion 122*a* coincides with and is substantially aligned with a central axis of the shaft portion 121.

As shown in FIG. 4A, a connecting hole 14 which can be engaged with the connecting shaft 12*a* is formed in the connecting portion 3. The connecting hole 14 includes an engagement region 142 and an insertion region 141 continuously. The engagement region 142 has a configuration or size large enough such that the shaft portion 121 is allowed to pass through but also small enough such that the bulge portion 122*a* is not allowed to pass through. The insertion region 141 has such a configuration or size large enough that the bulge portion 122 is allowed to pass through. The bulge portion 122*a* passes through the insertion region 141 when the bulge portion 122*a* and the shaft portion 121 are inserted into the insertion region 141. The shaft portion 121 is moved from the insertion region 141 to the engagement region 142 so that the base 6 and the connection member 3 are connected. In this state, the shaft portion 121 is positioned in the engagement region 142, and the bulge portion 122*a* is not allowed to pass through the engagement region 142 and the bulge portion 122*a* is positioned on the left side with respect to the connecting portion 3. In this manner, the connection between the base 6 and the connecting portion 3 is maintained. The insertion region 141 and the engagement region 142 are positioned to be contiguous with each other at the forward end of the engagement region 142, forming the substantially L-shaped connecting hole 14.

As shown in FIG. 4, the connecting portion 3 is provided with an elastically deformable stopper piece 13*a*. The stopper piece 13*a* is configured to keep the shaft portion 121 in the engagement region 142 to prevent the connecting shaft 12*a* from moving in the forwards direction from the engagement region 142 to the insertion region 141. The side surface of the stopper piece 13, partially parallel to the YZ plane, contacts a strip-shape side surface 122*aa* of the disc-shape bulge portion 122*a*, which is also partially parallel to the YZ plane. As shown in FIG. 5, the portions of the bulge portion 122*a* and the stopper piece 13*a* which are parallel to the YZ plane face opposite to each other, and are aligned in the forward and backward directions when the shaft portion 121 is positioned within the engagement region 142. Since the stopper piece 13*a* in this state can restrict the movable range of the shaft portion 121 within the engagement region 25 in moving forward towards the insertion region 141, the movement of the connecting shaft 12*a* toward the insertion region 141 is thereby restricted.

As shown in FIG. 4, a part of the stopper piece 13*a* is indented in the leftward direction such that it extends over and covers a part of the insertion region 141. When the connecting shaft 12*a* is inserted into the insertion region 141 from the rightward to the leftward direction in order to connect the base 6 and the connecting portion 3, the elastically deformable stopper piece 13*a* is temporally pushed further towards the left side of the joint portion 36 compared to the default position shown in FIG. 6. As shown in FIG. 4, the stopper piece 13*a* returns to its normal position (the position as shown as an embodiment in FIG. 6) due to the elastic force when the connecting shaft 12*a* is moved backwards into the engagement region 142 after having entered into the insertion region 141. Normally, in this state, because of the aforementioned small size of the engagement region 142 compared to the bulge portion 122*a*, and barrier in the forwards direction formed by the stopper piece 13*a*, the connecting shaft 12*a* is not removed from the connecting hole 14.

As shown in FIG. 4, the stopper piece 13*a* moves when significant force is exerted against it, wherein such force may for example cause the connecting shaft 12*a* positioned in the engagement region 142 to move towards the insertion region 141. A forwards surface of the stopper piece 13*a* parallel to the YZ plane and a backwards surface of the bulge portion 122*a* parallel to the YZ plane facing opposite to each other overlap along the forwards-backwards axis if the stopper piece 12*a* is moved forwards towards the right side of the joint portion 36 in FIG. 6. At this time, as a part of the stopper piece 13*a* is positioned between the bulge portion 122*a* and the base portion B, the connecting shaft 12*a* can thereby be prevented from being removed from the connecting hole 14. Conversely, the connecting shaft 12*a* may be easily removed from the connecting hole 14 when the stopper piece 13*a* moves backwards towards the left side of the joint portion 36 in FIG. 6. Accordingly, a guide mechanism 18 (see FIG. 5) is provided for guiding the stopper piece 13*a* to move easily forward towards the right side of the joint portion 36 in FIG. 6 when the above noted force is exerted.

As shown in FIG. 5, the guide mechanism 18 includes an inclined surface 181 on the stopper piece 13*a* for guiding the stopper piece 13*a* to move easily in a position between the bulge portion 122*a* and the base portion B when the predetermined force is applied to move the connecting shaft 12*a*. The inclined surface 181 is positioned for the majority of the width of the stopper portion 13*a* in the Y direction, facing the bulge portion 122*a* such that at least one part of the stopper piece 13*a* may be positioned between the bulge portion 122*a* and the base portion B as the bulge portion 122*a* moves along the inclined surface 181 in the forward and leftward direction.

As shown in FIG. 5, the stopper piece 13*a* includes a contact surface 131 which is formed parallel to the YZ plane for the minority of the width of the stopper portion 13*a* in the Y direction, such that said contact surface is substantially perpendicular to a force direction wherein the force is applied by the strip-shape side surface 122*aa* of the bulge portion 122*a*. The inclined surface 181 is configured to be inclined about 45 degrees with respect to the contact surface 131. The movable range of the connecting shaft 12*a* is limited by the contact surface 131 abutting the strip-shape side surface 122*aa* of the bulge portion 122*a*. This contact surface 131 may serve as a primary means to prevent the connecting shaft 12*a* from disengaging with the connecting hole 14. When substantial predetermined force is applied so that an abutting state of the contact surface 131 with respect to the bulge portion 122*a* cannot be maintained, the guide mechanism 18 and its inclined surface 181 may serve as a secondary means to prevent the connecting shaft 12*a* from disengaging from the connecting hole 14.

As shown in FIG. 3, the stopper piece 13*a* is molded at the same time as, and integrally with, the resin joint portion 36, and is configured to be inseparable from the joint portion 36. The stopper piece 13*a* extends downwardly and is configured to have a stepped, leftwards-indented configuration as seen from a side view. As shown in FIG. 4, the stopper piece 13*a* is configured to have a stepped configuration to form a barrier against a penetration direction, from the rightwards-to-leftwards side, of the connecting hole 14. The contact surface 131 formed on a lateral side of the stopper piece 13*a*, as described above and shown in FIG. 5, can contact the strip-shape side surface 122*aa* of the bulge portion 122*a* in an assembled state. Furthermore, compared to other embodiments, with the stepped, leftwards-indented configuration, the amount of elastic deformation of the stopper piece 13*a* is reduced during the assembly in which the shaft portion 121 is inserted into the connecting hole 14. For example, in an alternative embodiment, the connecting shaft 12 can be configured to be flat, without the above noted stepped, leftwards-indented configuration and can be positioned in the engagement region 142. In this case, the stopper piece

13*a* is located adjacent to the shaft portion 121 of the engagement region 142, instead of overlapping with the bulge portion 122*a* as above. Thus, to insert the shaft portion 121 into the connecting hole 14, the stopper piece needs to be undergo a greater degree of elastic deformation compared to the embodiment shown in FIG. 4 when the connecting shaft 12 is inserted in the insertion region 141, with stopper piece 13*a* having a stepped configuration, to allow the insertion of the connecting shaft 12 into the insertion region 141.

As shown in FIG. 5, the stopper piece 13*a* is configured so that the stopper piece 13*a* can abut the base portion B when the stopper piece 13*a* is deformed towards the base portion B by using the guide mechanism 18 including surface 181, by applied force in the rightwards direction. This abutment configuration may limit the displacement of the stopper piece 13*a*. In addition, the stopper piece 13*a* is configured such that the connecting shaft 12*a* cannot completely traverse the connecting hole 14 shown in FIG. 4 even when the stopper piece 13*a* is moved to its utmost rightwards limit (in the negative Y direction) towards the base portion B. Therefore, the stopper piece 13*a* is configured such that the connecting shaft 12*a* cannot be disengaged from the connecting hole 14 when the stopper piece 13*a* is moved towards the base portion B.

The fuel supply device 1 has a configuration to prevent the base 6 and the connecting portion 3 from being unexpectedly separated. Therefore, the fuel supply device 1 can be efficiently assembled. For example, the base 6 and the connecting portion 3 may be prevented from being separated even when excessive force is applied to the connecting shaft 12*a* through the rotation regulation mechanism 19.

The specific embodiments of the present disclosure have been described with reference to the above configurations, however, it is obvious for a person skilled in the art that various replacements, modifications and changes are possible without departing from the object of the present disclosure. Therefore, the embodiments of the present disclosure may include all replacements, modifications and changes, which do not depart from the gist and the object of the attached claims. For example, the embodiments of the present disclosure is not limited to the specific configuration but may be changed as will be described below.

The guide mechanism 18 may have a configuration shown in FIG. 7 instead of the configuration shown in FIG. 5. The guide mechanism 18 shown in FIG. 7 includes a recess 182 in the stopper piece 13*b* at a position opposed to the bulge portion 122*b* along the leftwards-rightwards axis. A stepped configuration is established by formation of the recess 182. The recess 182 is configured such that the backward-right corner of bulge portion 122*b*, as shown in FIG. 7, can be fitted into the recess 182 when from a state in which a strip-shape side surface 122*ba* of the bulge portion 122*b* contacts the contact surface 131 a predetermined amount of force is further applied. Therefore, in this manner, the connecting shaft 12*b* may be prevented from passing through the insertion region 141 and from disengaging from the insertion region 141.

The guide mechanism 18 may have a configuration shown in FIG. 8 instead of the configuration shown in FIG. 5. The guide mechanism 18 shown in FIG. 8 does not have an inclined surface on a stopper piece 13*c* but instead has an inclined surface 183 on the connecting shaft 12*c*. In particular, the bulge portion 122*c* is configured to move along the inclined surface 183 when from a state in which a strip-shape side surface 122*ca* of the bulge portion 122*c* contacts the contact surface 131, a predetermined amount of force is further applied. Therefore, in this manner, the connecting shaft 12*c* may be prevented from passing through the insertion region 141 and from disengaging from the insertion region 141. Further, although not shown in the drawings, a stepped configuration as shown in FIG. 7 may also be provided in a surface of the bulge portion 122*c* wherein the stepped portion of the surface is closer to the base main body 61. Alternatively, although not shown in the drawings, an inclined surface may be formed on the both stopper piece 13*c* and the connecting shaft 12*c*.

The guide mechanism 18 may have a configuration shown in FIG. 9 instead of the configuration shown in FIG. 5. The guide mechanism 18 shown in FIG. 9 is configured to define the positional relation of the stopper piece 13*d* to a bulge portion 122*d* in a normal state. More specifically, the bulge portion 122*d* includes a contact surface positioned on the side closer to the base main body 61. The contact surface is positioned slightly further in the outer peripheral direction (leftwards) than the leftwards extent of the thickness of the stopper piece 13*d*. Due to said positioning, the contact surface pushes the outer peripheral to the leftward side of the stopper 13*d* when the connecting shaft 12*d* moves in the backwards direction such that torsional force is applied to the stopper piece 13*d*. Consequently, the stopper piece 13*d* may move more easily towards the base main body 61. From a state in which a strip-shape side surface 122*da* of the bulge portion 122*d* contacts the contact surface 131, the stopper piece 13*d* moves backwards and to the right when a predetermined amount of force is further applied. Accordingly, the guide mechanism 18 is configured to prevent the connecting shaft 12*d* from passing through the insertion region 141 and from disengaging from the insertion region 141.

According to the above embodiments, the connecting shaft is provided at the base and the connecting hole is formed in the connecting portion. Alternatively, the connecting shaft may be provided in the connecting portion and the connecting hole may be formed in the base.

According to the above embodiments, the base and the connecting portion are pivotally connected to each other. Alternatively, they may be connected so that the shaft portion is restricted but can only move lineally within the insertion region. Thereby, the base and the connecting portion are movably connected each other.

According to the above embodiments, the stopper piece is provided inseparably at the connecting portion in an integral configuration. Alternatively, the stopper piece may be separably attached using (a) fixing member(s) etc.

According to the above embodiments, the stopper piece is configured to have a stepped configuration as seen from a side view. Alternatively, the stopper piece may be configured to have a flat plate shape.

According to the above embodiments, the stopper piece is configured to move towards the base portion when a predetermined amount of force is applied. Alternatively, it may be also possible to configure the device such that the bulge portion may move in a direction away from the base portion instead of towards the base, or such that the bulge portion may undergo elastic deformation.

A canister filled with an adsorbent material may be provided at the cover. In this case, the connecting portion may be configured to connect the canister with the pump unit. The connecting portion still may be configured to connect a set plate with the pump unit even if the canister is provided at the cover.

The filter member at the base is not essential, therefore, a configuration without a filter member may be adopted. In this case, the filter member may also be arranged at any other parts than the base as well. As far as the fuel to be sucked by the pump is kept clean, the fuel supply device may be configured without a filter member.

An angle defined by the contact surface 131 and the inclined surface 181 shown in FIG. 5 is 45 degrees. This angle is not limited to the measure of 45 degrees, however, and may be any angle as far as it serves as an element of the guide mechanism. For example, the angle may be between 30 to 90 degrees. Further, the guide mechanism 18 may have an inclined surface with a curved surface which continues to the end of the contact surface 131 instead of the planar inclined surface 181.

According to the above embodiments, the bulge portion is positioned at the leftmost end of the connecting shaft. Alternatively, the bulge portion may be positioned in the middle of the connecting shaft. Also in this case, the bulge portion is configured such that it can pass through the insertion region but cannot pass through the engagement region.

According to the above embodiments, the bulge portion has a disc shape. Alternatively, the bulge portion may have any other various configurations, for example, a spherical configuration or a pyramid configuration.

As a vehicle, the scope of the disclosure is not limited in application to an automobile. Namely, another vehicle may be adopted, such as one that flies in the air, e.g. an airplane or a helicopter, or that moves over the sea or in the sea, e.g. a ship or a submarine.

The invention claimed is:

1. A fuel supply device comprising:

a cover including a set plate configured to cover an opening of a fuel tank;

a base including a base main body, comprised of an upper base to which a fuel pump is attached, as well as a lower base configured to abut a bottom surface of the fuel tank; and a connecting portion including a rod member and a joint portion configured to allow the connection portion to be extendable and retractable along the rod member, where additionally a spring member is present between the joint portion and the cover, wherein the connecting portion is configured to connect the cover and the base, wherein the base main body and the connecting portion are connected by:

a connecting shaft including a shaft portion extending from the upper base parallel to a Y-axis, perpendicular to an XZ plane, and a bulge portion comprising the terminal end of the shaft portion, with thickness of the shaft portion in an X direction increased at the bulge portion, relative to the shaft portion, a connecting hole at the joint portion relative to the XZ plane, that includes an engagement region through which the shaft portion of the connecting shaft is allowed to pass while the bulge portion is not, and an insertion region through which the bulge portion is allowed to pass, wherein the insertion region is contiguous with the engagement region, and a stopper piece configured to limit a movable range of the shaft portion of the connecting shaft towards the insertion region when the shaft portion is located within the engagement region, wherein the connecting portion and the base are connected in a relatively movable manner, through insertion of the connecting shaft into, and through its engagement with, the connecting hole, where a guide mechanism is provided wherein the guide mechanism is configured to guide at least one part of the connecting shaft or the stopper piece to move so that at least one part of the stopper piece is positioned between the bulge portion and the base, wherein the shaft portion is configured to have a two-tiered substantially columnar shape, as seen from a top view in the XY plane, where from rightwards to leftwards in the Y direction, the thickness width in the x direction progressively decreases from one tier to the next tier, wherein the bulge portion at the end of the second tier is on the opposite side of the connecting hole in the Y direction than the first tier of the shaft portion.

2. The fuel supply device of claim 1, wherein the base is able to rotate upwards or downwards about the connecting shaft parallel to the Y-axis, from an XY plane, when the cover of the fuel supply device is held and lifted, where when rotated, one longitudinal terminal end of the base main body faces the bottom surface of the fuel tank.

3. The fuel supply device of claim 2, wherein a rotation regulation mechanism is provided for regulating a rotation range of the base with respect to the connecting portion, wherein the rotation regulation mechanism comprises a flange on the outer periphery of the top basal surface of the upper base, wherein the flange contacts the connecting portion when the base rotates to a predetermined position.

4. The fuel supply device of claim 1, wherein a cross sectional area of the bulge region parallel to the XZ plane is larger than a cross sectional area of the shaft portion of the connecting shaft parallel to the XZ plane, wherein both said planes are perpendicular to and intersect a central axis of the connecting shaft parallel to the Y axis.

5. A fuel supply device comprising:

a cover including a set plate configured to cover an opening of a fuel tank;

a base including a base main body, comprised of an upper base to which a fuel pump is attached, as well as a lower base configured to abut a bottom surface of the fuel tank; and a connecting portion including a rod member and a joint portion configured to allow the connection portion to be extendable and retractable along the rod member, where additionally a spring member is present between the joint portion and the cover, wherein the connecting portion is configured to connect the cover and the base, wherein the base main body and the connecting portion are connected by:

a connecting shaft including a shaft portion extending from the upper base parallel to a Y-axis, perpendicular to an XZ plane, and a bulge portion comprising the terminal end of the shaft portion, with thickness of the shaft portion in an X direction increased at the bulge portion, relative to the shaft portion, a connecting hole at the joint portion relative to the XZ plane, that includes an engagement region through which the shaft portion of the connecting shaft is allowed to pass while the bulge portion is not, and an insertion region through which the bulge portion is allowed to pass, wherein the insertion region is contiguous with the engagement region, and a stopper piece configured to limit a movable range of the shaft portion of the connecting shaft towards the insertion region when the shaft portion is located within the engagement region, wherein the connecting portion and the base are connected in a relatively movable manner, through insertion of the connecting shaft into, and through its engagement with, the connecting hole, where a guide mechanism is provided wherein the guide mechanism is configured to guide at least one part of the connecting shaft or the stopper piece to move so that at least one part of the stopper piece is positioned between the bulge portion and the base, wherein the connecting hole forms a substantially L-shaped region, wherein the stopper is elastically deformable and is configured to have a stepped, leftwards-intended configuration, so as to form a barrier against penetration direction from the rightwards to the leftwards side of the connecting hole.

6. The fuel supply device of claim 5, wherein a side lateral surface of the stepped leftwards-indented stopper comprises two surfaces, the first surface formed parallel to a YZ plane for a minority of the width of the stopper portion in the Y direction, where said first surface is perpendicular to a force direction, when force is applied by a oppositely facing side surface of the bulge portion, where the second surface of the side lateral surface, forming a majority of the width of the stopper portion in the Y direction is oriented at an angle relative to the first surface, and guides the stopper piece to move forward and towards the base, such that the stopper piece is in a position between the bulge portion and the base main body in the Y direction, when a predetermined amount of force is applied to move the connecting shaft at said oppositely facing side surface of the bulge portion, wherein the connecting shaft is prevented from passing through the insertion region and from disengaging from the insertion region.

7. The fuel supply device of claim 5, wherein the stopper is formed in an integral construction with the joint portion of the connecting portion.

8. The fuel supply device of claim 5, wherein a side lateral surface of the stepped leftwards-indented stopper includes a rectangular recess in the stopper piece at a forward-left corner of the stopper from a top view parallel to the XY plane, where the side lateral surface is opposed to a side lateral surface of the bulge portion along a leftwards-rightwards axis, wherein the stopper is configured such that a backward-right corner of the bulge portion can be fitted into the recess when from a state in which the side lateral surface of the bulge portion contacts the opposing side lateral surface of the stopper, a predetermined amount of force is further applied, wherein the connecting shaft is prevented from passing through the insertion region and from disengaging from the insertion region.

9. A fuel supply device comprising:

a cover including a set plate configured to cover an opening of a fuel tank;

a base including a base main body, comprised of an upper base to which a fuel pump is attached, as well as a lower base configured to abut a bottom surface of the fuel tank; and a connecting portion including a rod member and a joint portion configured to allow the connection portion to be extendable and retractable along the rod member, where additionally a spring member is present between the joint portion and the cover, wherein the connecting portion is configured to connect the cover and the base, wherein the base main body and the connecting portion are connected by:

a connecting shaft including a shaft portion extending from the upper base parallel to the Y-axis, perpendicular to the XZ plane, and a bulge portion comprising the terminal end of the shaft portion, with thickness of the shaft portion in the X direction increased at the bulge portion, relative to the shaft portion, a connecting hole at the joint portion relative to the XZ plane, that includes an engagement region through which the shaft portion of the connecting shaft is allowed to pass while the bulge portion is not, and an insertion region through which the bulge portion is allowed to pass, wherein the insertion region is contiguous with the engagement region, and a stopper piece configured to limit a movable range of the shaft portion of the connecting shaft towards the insertion region when the shaft portion is located within the engagement region, wherein the connecting portion and the base are connected in a relatively movable manner, through insertion of the connecting shaft into, and through its engagement with, the connecting hole, where a guide mechanism is provided wherein the guide mechanism is configured to guide at least one part of the connecting shaft or the stopper piece to move so that at least one part of the stopper piece is positioned between the bulge portion and the base, wherein the connecting hole forms a substantially L-shaped region, wherein the stopper is elastically deformable and has the thickness width in the x direction which progressively decreases from right to left as seen from a side view, so as to form a barrier against penetration direction from the rightwards to the leftwards side of the connecting hole.

* * * * *